United States Patent [19]

Aihara et al.

[11] 4,304,207

[45] Dec. 8, 1981

[54] EXHAUST GAS RECIRCULATION SYSTEM FOR AN INTERNAL COMBUSTION ENGINE

[75] Inventors: Hisamoto Aihara, Yokohama; Yasuhiko Nakagawa, Kamakura; Suzuo Suzuki, Yokosuka; Yasuo Matsumoto, Yokohama, all of Japan

[73] Assignee: Nissan Motor Co., Ltd., Yokohama, Japan

[21] Appl. No.: 45,682

[22] Filed: Jun. 5, 1979

[30] Foreign Application Priority Data

Sep. 5, 1978 [JP] Japan ..... 53-108128
Sep. 12, 1978 [JP] Japan ..... 53-111265

[51] Int. Cl.[3] ..... F02M 25/06
[52] U.S. Cl. ..... 123/568; 60/279
[58] Field of Search ..... 123/568; 60/279

[56] References Cited

U.S. PATENT DOCUMENTS 3,579,981 5/1971 Gau ..... 60/279
4,165,721 8/1979 Virk ..... 123/568

*Primary Examiner*—Wendell E. Burns
*Attorney, Agent, or Firm*—Schwartz, Jeffery, Schwaab, Mack, Blumenthal & Koch

[57] ABSTRACT

An exhaust gas recirculation system for an internal combustion engine includes an exhaust gas recirculation passage for communicating an exhaust port with an intake passage through a recirculation flow control valve. The recirculation system according to the invention comprises a timing valve in the recirculation passage adapted to open at specified moments for extracting exhaust gases containing highly concentrated hydrocarbons. According to the invention, moreover, the exhaust port is concentrically divided into a plurality of ports to extract exhaust gases having high concentrations of hydrocarbons from the outermost divided port adjacent to the inner peripheral walls of the exhaust port to recirculate them into intake mixtures, thereby reducing the concentrations of hydrocarbons and nitrogen oxides in exhaust gases and thus fuel consumption.

2 Claims, 21 Drawing Figures

EXHAUST GAS RECIRCULATION SYSTEM FOR AN INTERNAL COMBUSTION ENGINE

BACKGROUND OF THE INVENTION

1. Field of the Invention

This invention relates to an exhaust gas recirculation system of an internal combustion engine for effectively reducing HC (unburned hydrocarbons) and NOx (nitrogen oxides) in exhaust gases discharged from the engine.

2. Description of the Prior Art

It has been well known to re-introduce small amounts of exhaust gas in an exhaust passage into an intake mixture to restrain a combustion of the mixture in order to reduce the nitrogen oxides in the exhaust gases effectively.

In conventional exhaust gas recirculation systems, an exhaust manifold assembly and an intake passage are generally connected through an exhaust circulation passage including in its midway a recirculation flow control valve. The hydrocarbons in the exhaust gases are simultaneously recirculated into the intake passages so as to treat the hydrocarbons.

The concentration of the hydrocarbon in the exhaust gas discharged into the exhaust port of an internal combustion engine is not constant during one cycle of the engine. The maximum concentration of the hydrocarbon will occur immediately after opening the exhaust valve and immediately before closing the valve, because the hydrocarbon in quenched layers around the wall of a head of a combustion chamber is peeled therefrom by opening the exhaust valve to be exhausted along inner peripheral walls of the exhaust port, while the hydrocarbon in quenched layers at the cylinder wall is scratched by a raising piston to be exhausted immediately before closing the exhaust valve.

In the most of exhaust gas recirculation systems of the prior art, the exhaust gases from the manifold assemblies are continuously recirculated without considering such a variation in concentration of hydrocarbon, so that the exhaust gases having low concentrations of hydrocarbons containing completely burned exhaust gases are extracted, with the result that the highly concentrated hydrocarbons in the exhaust gases cannot be effectively reduced. In addition, the exhaust gas recirculation lowers the combustion temperature to increase the total amount of the hydrocarbon, so that exhaust after-treatment devices having large capacities such as catalyst converters are required.

SUMMARY OF THE INVENTION

It is therefore an object of the invention to provide an improved exhaust gas recirculation system comprising a timing valve which opens to feed the exhaust gases having high concentration of hydrocarbons among the exhaust gases flowing through the exhaust port, thereby effectively treating in a combustion chamber the hydrocarbons in the recirculation gases, while keeping the nitrogen oxides (NOx) restraining effect of the exhaust recirculation gases to reduce fuel consumption and concentration of exhausted hydrocarbon.

It is further object of the invention to provide an exhaust gas recirculation system adapted to extract exhaust gases having high concentrations of hydrocarbon from the proximity of the inner peripheral walls of an exhaust port to recirculate them into intake mixtures, thereby reducing the concentrations of hydrocarbons and nitrogen oxides in exhaust gases and thus fuel consumption.

It is still more object of the invention to provide an exhaust gas recirculation system capable of effectively extracting the exhaust gases having highly concentrated hydrocarbons by controlling the flow and pressure of extra highly concentrated hydrocarbon exhaust gases other than the required exhaust recirculation gases, and further achieving the purification of the extra highly concentrated hydrocarbon exhaust gases.

The exhaust gas recirculation system for an internal combustion engine including an exhaust gas recirculation passage for communicating an exhaust port with an intake passage through a recirculation flow control valve according to the invention, comprises a normally closed timing valve provided in said exhaust gas recirculation passage and opening at specified moments for extracting exhaust gases having a high concentration hydrocarbon flowing in said exhaust port into which an exhaust extraction port of said exhaust gas recirculation passage opens.

In another aspect of the exhaust gas recirculation system for an internal combustion engine according to the invention comprises means for dividing a part of an exhaust port into a plurality of ports, an exhaust gas recirculation passage for recirculating a part of exhaust gas in the port adjacent to an inner peripheral wall of said exhaust port, through which an exhaust gas having a high concentration of hydrocarbon flows, and an exhaust after-treatment passage for introducing the remainder of said exhaust gas through exhaust after-treatment means and pressure control means into any one of a part of said exhaust port through which an exhaust gas having a low concentration of hydrocarbon flows and a part of said exhaust port downstream thereof.

The invention will be more fully understood by referring to the following detailed specification and claims taken in connection with the appended drawings.

DETAILED DESCRIPTION OF THE PREFERRED EMBODIMENTS

Figure 1:
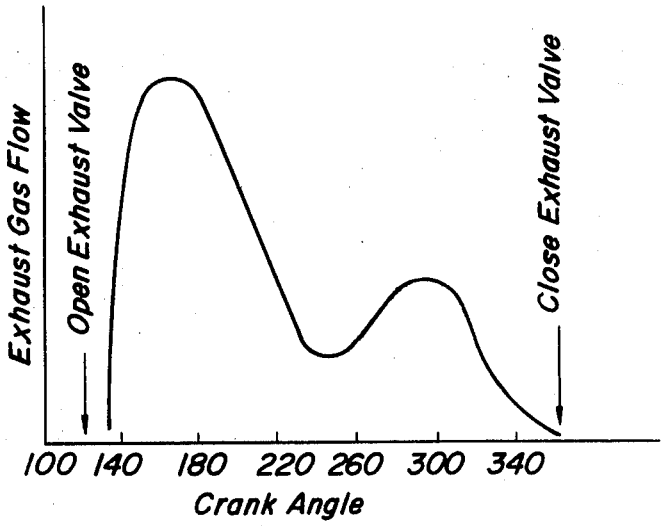
FIG. 1 is a graph illustrating a relation between crank angles and exhaust gas flow of an engine.
Figure 2:
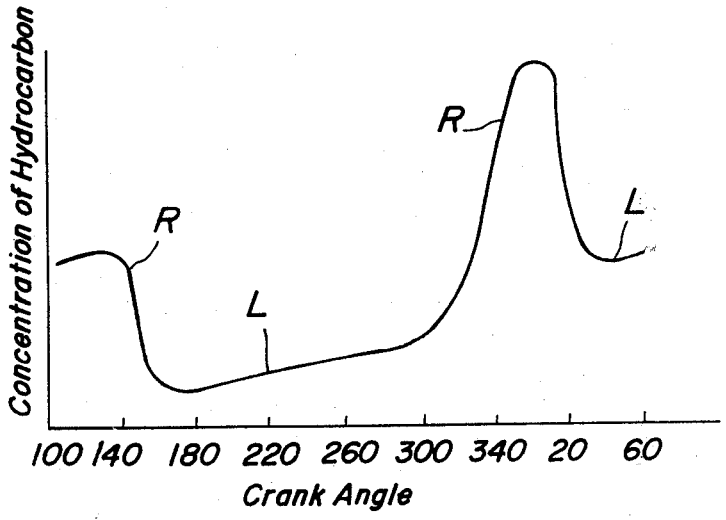
FIG. 2 is a graph illustrating a relation between crank angles and concentration of hydrocarbon in the exhaust gas of the engine.
Figure 3:
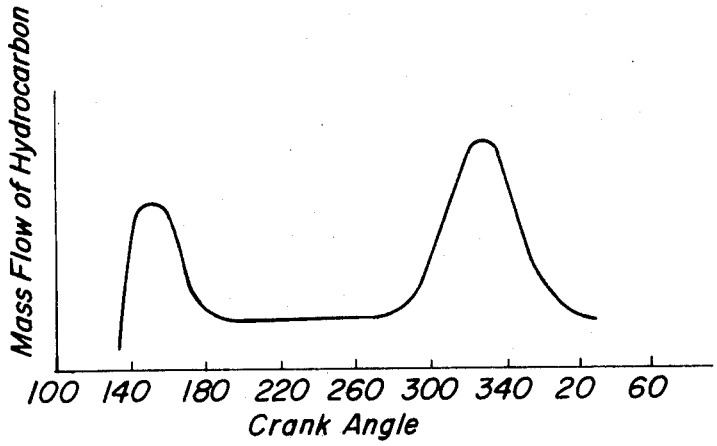
FIG. 3 is a graph illustrating a relation between crank angles and mass flow of the hydrocarbon obtained by the curves in FIGS. 1 and 2.

FIGS. 1 and 2 illustrate variations in exhaust gas flow and concentration of hydrocarbon at an exhaust port of an internal combustion engine in connection with crank angles, respectively. Mass flows of the hydrocarbon obtained by the values in FIGS. 1 and 2 are shown in FIG. 3. As can be seen from these graphs, the concentration or flow mass of the hydrocarbon at the exhaust port in an exhaust cycle is in the form of a wave having two peaks. It should be understood that the highly concentrated hydrocarbons are concentrically exhausted at moments immediately after opening an exhaust valve and immediately before closing the exhaust valve, because the fuel in quenched layers around a head of a combustion chamber is peeled therefrom to be exhausted at the former moment and the fuel in quenched layers at a cylinder wall is scratched therefrom to be exhausted by the raising piston at the latter moment, which would increase the concentration of the hydrocarbon in the exhaust gas.

The exhaust gas recirculation system according to the invention is constructed in consideration of this phenomenon as explained hereinafter.

Figure 4:
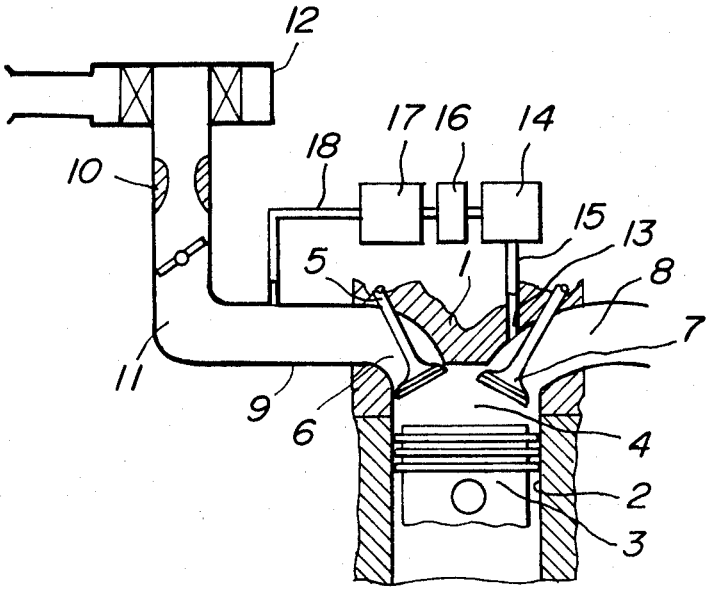
FIG. 4 is a schematic sectional view of an exhaust gas recirculation system showing the principle of the present invention.

Referring to FIG. 4 illustrating the principle of the present invention a cylinder head 1, a cylinder block 2 and a piston 3 form a combustion chamber 4 connected with an intake port 6 and an exhaust port 7 in the cylinder head 1, which are adapted to be closed and opened by an intake valve 5 and an exhaust valve 7, respectively. The intake port 6 communicates with an air cleaner 12 through an intake passage 11 formed by an intake manifold 9 and a carburettor 10. The exhaust port 8 communicates with an exhaust after-treatment device through an exhaust manifold (not shown).

An exhaust extraction port 13 opening into the exhaust port 8 of the combustion chamber 4 is connected to a mixing chamber 16 through an exhaust extraction passage 15 connected to the exhaust port 8 of each cylinder and including a timing valve 14 adapted to open only at determined moments. The mixing chamber 16 is communicated with the intake passage 11 through a main exhaust gas recirculation passage 18 including a recirculation flow control valve 17 constructed in a conventional manner. The mixing chamber may be dispensed with.

Figure 5:
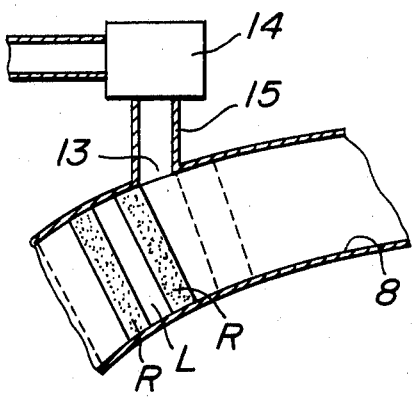
FIG. 5 is an explanatory partial sectional view of one embodiment of the present invention.
Figure 6:
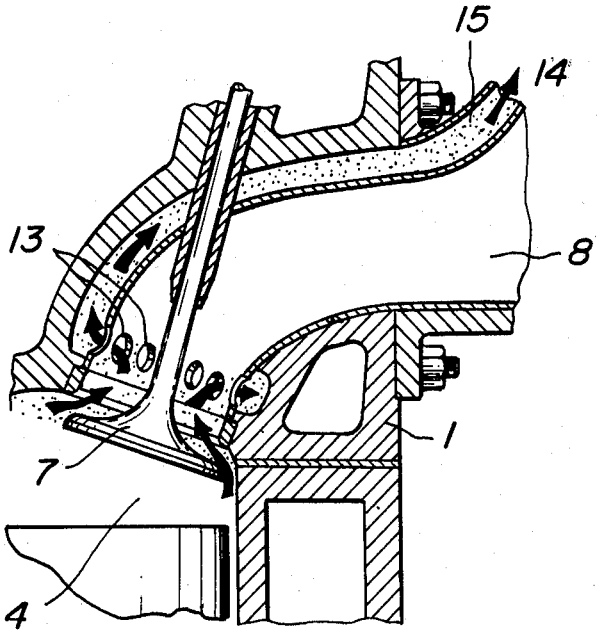
FIG. 6 is a sectional view of other embodiment of the present invention.
Figure 7:
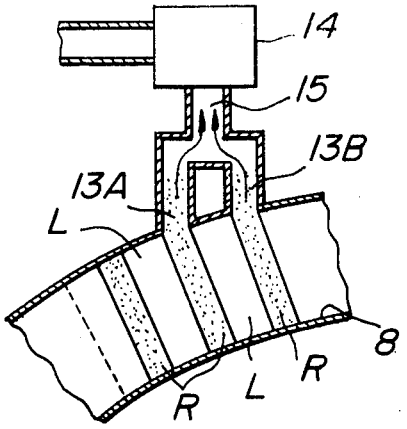
FIG. 7 is a sectional view of further embodiment of the present invention.

The exhaust extraction port 13 may open at a plurality of openings into the exhaust port as shown in FIGS. 6 and 7 and also may open at a single opening as shown in FIG. 5.

The timing valve 14 is so constructed as to open twice every one revolution of an engine at determined moments. In effect, the timing valve 14 is adjusted in timing so as to open by determined crank angles when the exhaust gases including the highly concentrated hydrocarbons pass through the exhaust extraction port 13. As explained referring to FIG. 2, the exhaust gas R including the highly concentrated hydrocarbon passes twice through the exhaust port 8 and the exhaust gas L of low hydrocarbon passes therethrough between the twice passages of the high hydrocarbon. With this arrangement, the exhaust gases including highly concentrated hydrocarbon immediately after opening the exhaust valve and immediately before closing the valve can be effectively extracted as the recirculation gas through the exhaust extraction port 13. The recirculation exhaust gases including the highly concentrated hydrocarbon extracted from the respective combustion chambers as above described are gathered together in the mixing chamber 16. The flow of the recirculation gas mixed in the chamber 16 is the controlled in the recirculation flow control valve 17, from which the recirculation gas is introduced through the main recirculation passage 18 into the intake passage 11 in which the recirculation gas is mixed with a fresh fuel mixture and is sucked under the mixed condition into respective combustion chambers 4 to be burned again and treated. In this manner, the exhaust gas recirculation lowers the combustion temperature to reduce the amount of produced NOx and the recirculation gas including the highly concentrated hydrocarbon is burned in the combustion chambers, thereby saving the energy and reducing the amounts of hydrocarbon to be fed into the after-treatment device. Such effects are great merits of the invention.

On the other hand, the residual exhaust gases from which the highly concentrated hydrocarbon has been removed includes only very low hydrocarbon, so that it is possible to make small the treatment capacity of an exhaust gas after-treatment device such as a catalyzer, reactor and the like.

In the above embodiment, the timing valve of one extraction port is adapted to open twice per one revolution of an engine with an interval in order to extract only the high hydrocarbon exhaust gas among the high and low hydrocarbon exhaust gases alternately passing through the exhaust port. Two exhaust extraction ports 13A and 13B may be provided positionally shifted in the flowing direction of the exhaust gas as shown in FIG. 7 and the timing valve may be opened once per one revolution of an engine which would accomplish the same effect as that of the previous embodiment.

If only one exhaust gas of the two high hydrocarbon exhaust gases during one cycle of an engine is sufficient to achieve the effect of the invention, only one exhaust extraction port may be provided for extracting one of the exhaust gases immediately after opening the exhaust valve or immediately before closing the valve and the timing valve may be set to be opened once per one revolution of an engine. Moreover, the exhaust gas may be not necessarily extracted from all the cylinders, but may be extracted from a specified cylinder or cylinders.

The timing valve adapted to open at determined moments used in the above embodiment will be explained hereinafter.

Figure 8B:
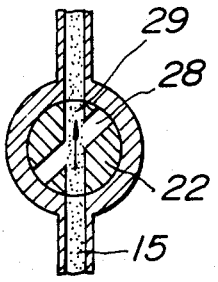
FIG. 8*b* is a sectional view of other embodiment of a timing valve used in the system according to the invention.
Figure 8A:
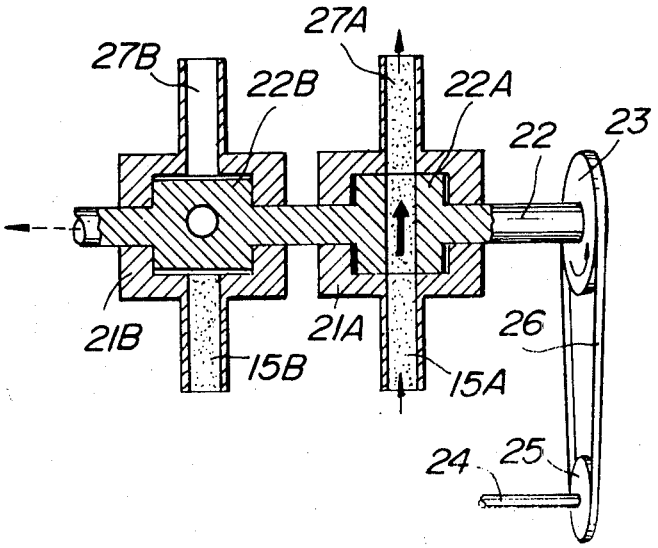
FIG. 8*a* is a sectional view of a timing valve used in the system according to the invention.

FIGS. 8 and 9 illustrate two embodiments of the timing valves 14 mechanically geared to or interlocked moving parts of an engine such as a crankshaft for closing and opening the valves in timing. In FIG. 8*a*, each exhaust extraction passage 15A, 15B, . . . is provided in its midway with a valve casing 21A or 21B within which is slidably rotated a rotary valve 22A, 22B, . . . which is integrally formed with a valve shaft 22 having one end fitted with a pulley or sprocket 23 which is driven by a crankshaft 24 of an engine through a chain 26 extending about the pulley 23 and a pulley or sprocket 25 mounted on one end of the crankshaft 24. The reduction ratio of the pulleys 23, 25, . . . is determined such that the valve shaft 22 is one half rotated per two rotations of the crankshaft 24 or one revolution of the engine. Each rotary valve 22A, 22B, . . . includes a passage 27A, 27B, . . . which communicates with each exhaust extraction passage 15A, 15B, . . . twice per one revolution of the valve. With the valve mechanism of this embodiment, therefore, the valves open once per one revolution of the engine. The relative positions of the respective passages 27A, 27B, . . . are of course shifted to each other by a determined distance. In order to open the rotary valve twice per one revolution of the engine to extract the high concentrated hydrocarbon exhaust gas, passages 28 and 29 are provided to open the valve four times per one revolution thereof as shown in FIG. 8*b*. So long as the exhaust extraction passage 15 is offset with respect to the center of the valve shaft 22, the valve mechanism can of course be so constructed that the rotary valve is opened once in one rotation per two revolution of the crankshaft.

Figure 9A:
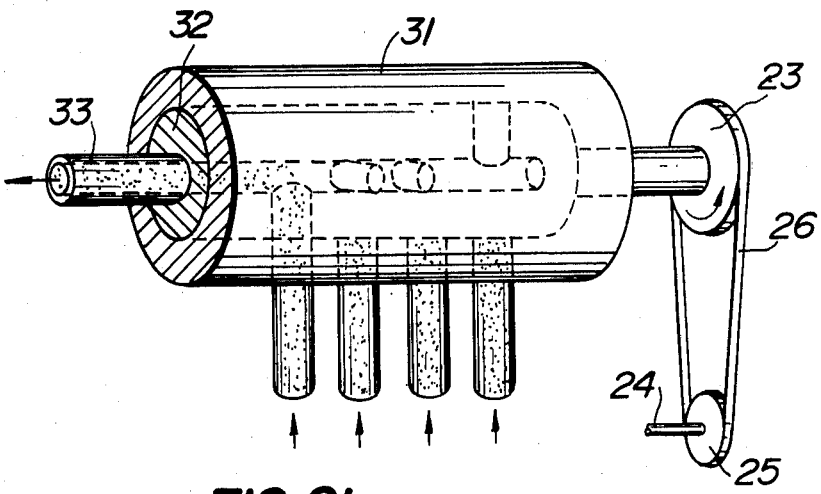
FIG. 9*a* is a perspective view of further embodiment of the timing valve used in the present invention.
Figure 9B:
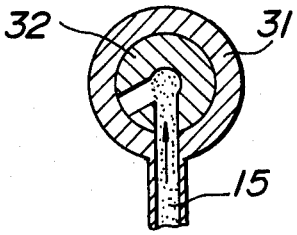
FIG. 9*b* is a sectional view of the timing valve.

Referring to FIG. 9 illustrating a modification of the timing valve 14 shown in FIG. 8, a rotary valve 32 is housed in a valve casing 31 and provided with a common outlet 33 extending along a center axis thereof on the side of the intake port. The timing valve shown in FIG. 9*a* opens once per one revolution of the engine. The valve shown in FIG. 9*b* opens twice per one revolution of the engine.

Figure 10:
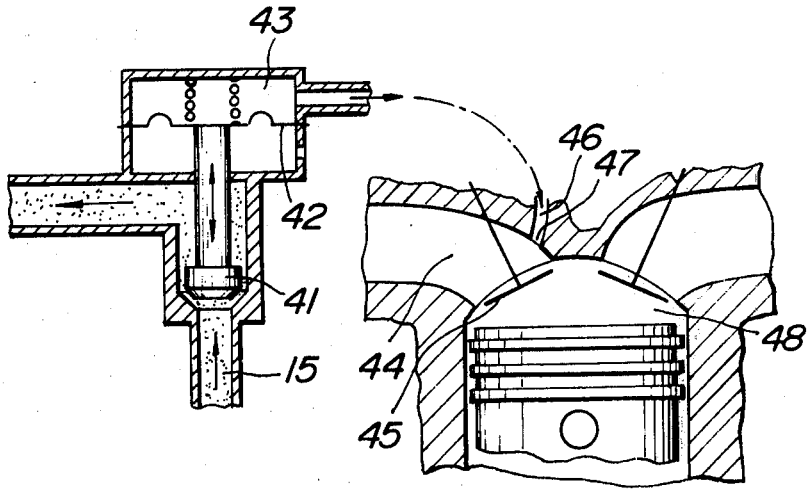
FIG. 10 is a sectional view of an additional embodiment of the timing valve.

FIG. 10 illustrates other embodiment of the timing valve 14 which is timed in closing and opening with the aid of the negative pressure caused by the intake of the engine. A valve body 41 located in an exhaust extraction passage 15 is connected to a diaphragm 42 to form a negative pressure operating chamber 43 on one side thereof, into which is introduced an intake negative pressure of a specified other cylinder 48. When the negative pressure in the chamber becomes lower than a determined value, the valve body 41 will raise from its seat to open the passage 15. The specified other cylinder 48 is such a cylinder which is in an intake cycle when the cylinder whose exhaust gas is to be extracted is in an exhaust cycle. An extraction port 47 of an intake negative pressure passage 46 opens in an intake port 44 in the proximity of an intake valve 45. The closing and opening the intake valve will cause pulsations in the intake negative pressure in the intake port in the proximity of the intake valve. Such variations in the intake negative pressure are utilized for timing in this embodiment.

Figure 11:
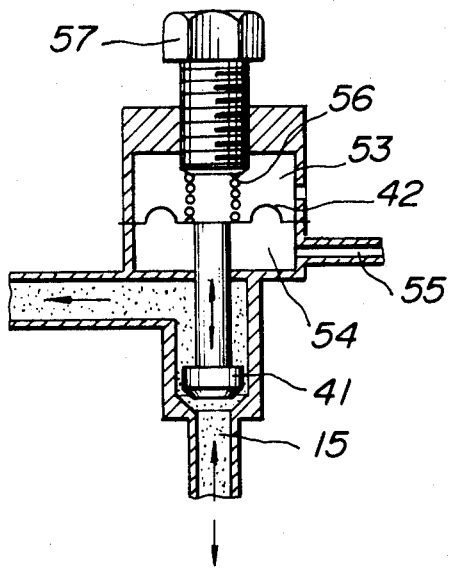
FIG. 11 is a sectional view of a further embodiment of the timing valve.
Figure 12:
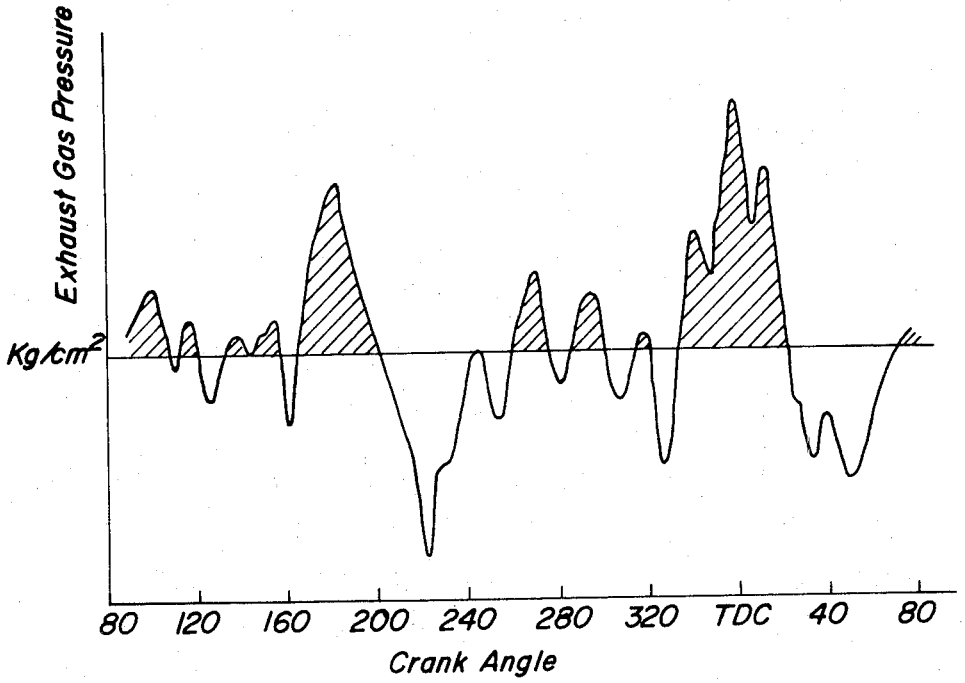
FIG. 12 is a graph illustrating the exhaust gas pressure characteristic in an exhaust port of an engine.

FIG. 11 illustrates one embodiment of a timing valve 14 utilizing the exhaust gas pressure. The exhaust gas pressure in an exhaust port varies as shown in a graph in FIG. 12. Instead of the negative pressure chamber 43 in FIG. 10, an atmospheric pressure chamber 53 is arranged on one side of a diaphragm 42. On the other side of the diaphragm is arranged a pressure chamber 54 into which is introduced the exhaust pressure in the exhaust port 8 through a passage 55. As can be seen from FIG. 12, the exhaust pressure has two peaks greatly exceeding 1 kg/cm$^2$ per one revolution of the engine. Accordingly, a diaphragm spring 56 is set at about 1 kg/cm$^2$ by a pressure adjusting bolt 57 to open the exhaust extraction passage 15 twice per one revolution of the engine at determined moments (strictly speaking at the shaded portions in FIG. 12).

The timing valves may be timed by an electronic control which would make it possible to control the timing much more finely. In short, it is necessary to operate the timing valve correspondingly to previously measured crank angles where the highly concentrated hydrocarbon is exhausted.

Figure 13A:
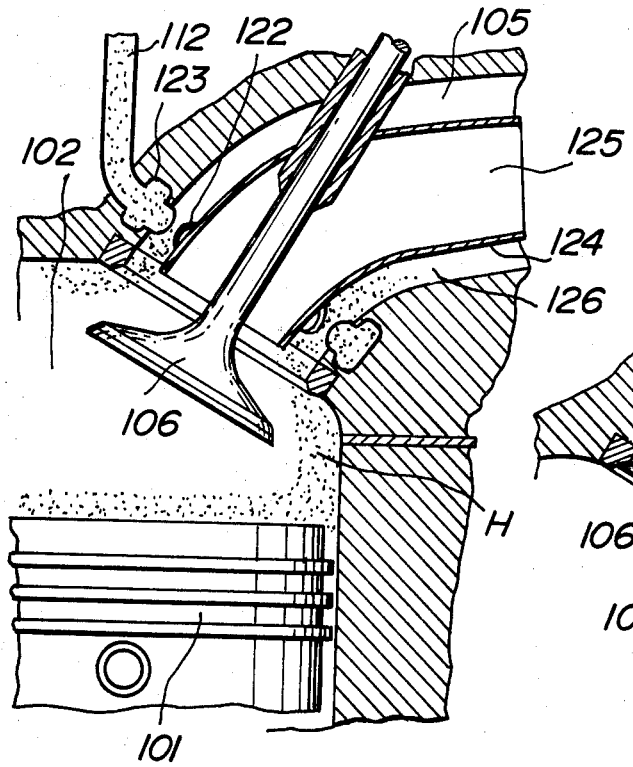
FIGS. 13*a* and 13*b* are sectional views of an exhaust port of further embodiment of the present invention.

FIG. 13 shows other embodiment of the present invention wherein an exhaust port is concentrically divided into a plurality of ports in order to extract the highly concentrated hydrocarbon more effectively. An exhaust port 105 is provided near an exhaust valve 106 with an inner exhaust port cylinder 124 concentrically inserted therein and fixed thereto to divide the exhaust port 105 into an inner exhaust port 125 and an outer exhaust port 126. Exhaust extraction ports 122 open in an exhaust port wall or an exhaust extraction tube extends into the exhaust port 105. With this arrangement, the exhaust gas having a high concentration of hydrocarbon tends to be guided into the outer exhaust port 126, thereby preventing the exhaust gas from mixing with the remaining exhaust gas having a low concentration of hydrocarbon in the inner exhaust port 125.

Figure 13B:
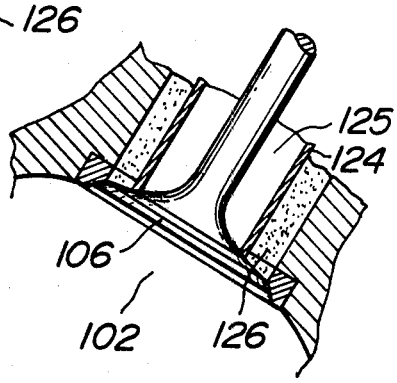
Figure 14:
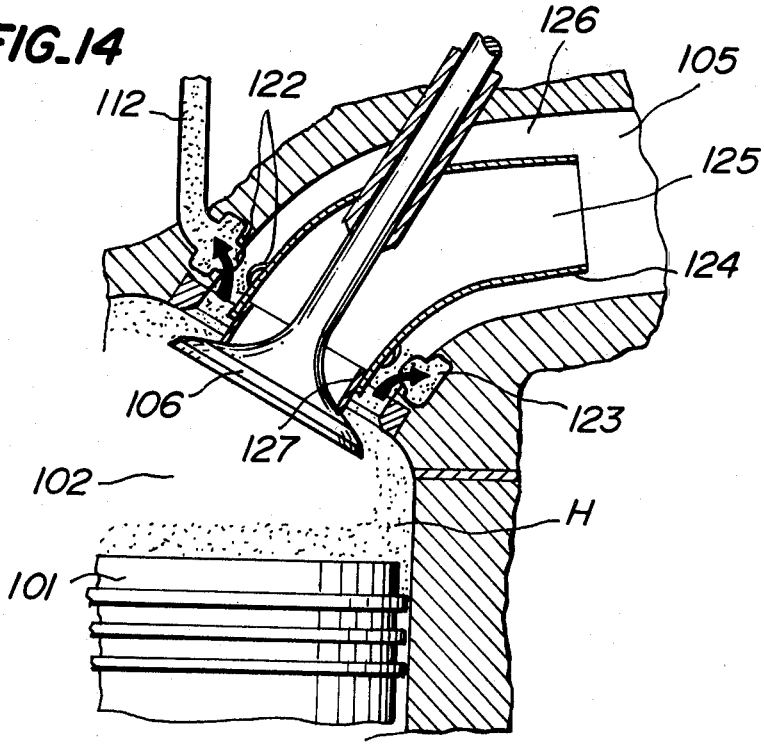
FIG. 14 is a sectional view of another embodiment of the exhaust port of the invention.

The exhaust port inner cylinder 124 may be so arranged that a valve land of the exhaust valve 106 seats the inner end of the inner cylinder 124 when the exhaust valve closes the exhaust port 105 as shown in FIG. 13*b*. As shown in FIG. 14, moreover, the exhaust valve 106 may be upstandingly provided on the valve land with a cylindrical shroud 127 so as to overlap the inner end of the inner cylinder 124 while the exhaust valve is slightly lifted. With this arrangement, while the lift of the exhaust valve 106 is small (40°–50° of crank angle) immediately after the exhaust valve is opened and immediately before the valve is closed the exhaust gas having a high concentration of hydrocarbon exhausted from the combustion chamber 102 into the exhaust port 105 is forced into the outer exhaust port 126 without being mixed with the exhaust gas having a low concentration of hydrocarbon.

The exhaust extraction port 122 shown in FIG. 3*a* may be located remote from the exhaust valve 106.

With the arrangements of the embodiments shown in FIGS. 13 and 14, a substantially constant constant amount of the exhaust gas having a high concentration of hydrocarbon per each cycle of the engine is introduced in the outer exhaust port 126. The amount of the recirculation gas is varied by means of control means 113 according to an operative condition. The extra recirculation gas is returned into the inner exhaust port or the downstream exhaust passage. If the amount of the returned recirculation gas is null or little the pressure in the outer exhaust port 126 will be raised with resulting low exhaust efficiency which tends to increase the residual gas in the combustion chamber. In contrast herewith, if the amount of the returned recirculation gas from the outer exhaust port 126 to the inner exhaust port or the downstream passageway exceeds a determined amount, the pressure in the outer exhaust port 126 will be lowered to suck thereinto the exhaust gas having a low concentration of hydrocarbon.

According to the invention, therefore, the extra recirculation gas having the high concentration of hydrocarbon to be returned into the exhaust gas having a low concentration of hydrocarbon is controlled in suitable amount to maintain the pressure in the outer exhaust port at a desired value thereby smoothly introducing the exhaust gas having the high concentration of hydrocarbon, and the residual extra recirculation gas having the high concentration of hydrocarbon is purified by an after-treatment before it is returned into the exhaust gas having the low concentration of hydrocarbon.

Figure 15:
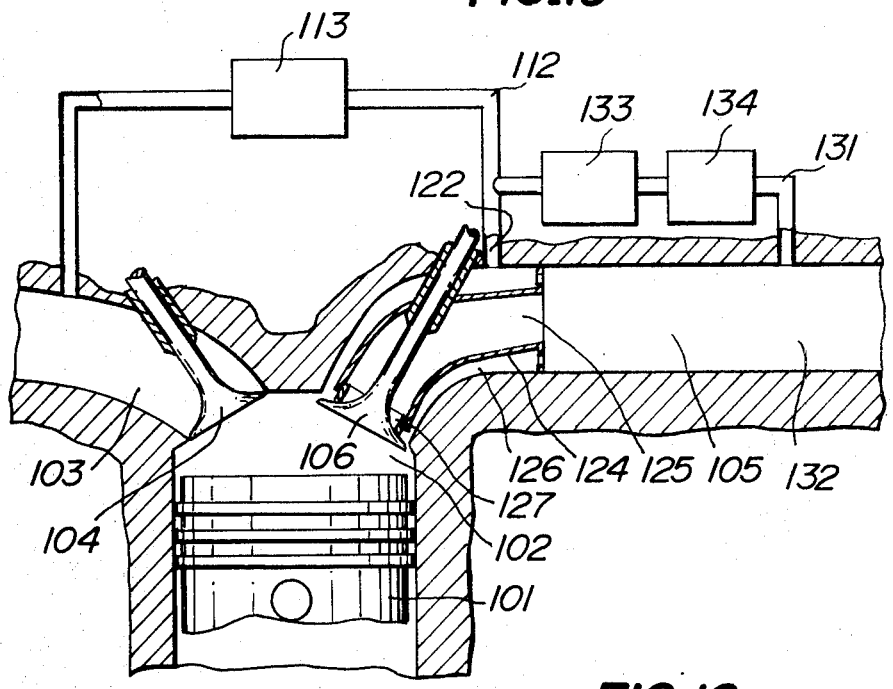
FIG. 15 is a schematic sectional view of an embodiment of an exhaust gas recirculation system according to the invention.

FIG. 15 illustrates the system embodying such a principle of the invention. According to the embodiment shown in FIG. 15, an outer exhaust port 126 has a closed downstream end, and an exhaust after-treatment passage 131 is branched between an exhaust extraction port 122 of an exhaust recirculation passage 112 and exhaust recirculation flow control means 113 and is connected to an exhaust passage 132 downstream of an inner exhaust port 125 and provided therein with an exhaust after-treatment device 133 and a pressure control device 134 for the outer exhaust port 126. The pressure control means 134 causes the extra recirculation exhaust gas to flow therethrough so as to keep the pressure in the outer exhaust port 126 at a constant value or causes the extra recirculation exhaust gas to flow therethrough correspondingly to the pressure in the outer exhaust port 126, thereby preventing the pressure in the port 126 from being extraordinarily raised or lowered. In this manner, the pressure in the outer exhaust port 126 is controlled by the flow control of the extra recirculation exhaust gas to prevent the increase of the residual exhaust gas in the combustion chamber 102 and the mixing of the exhaust gas having a low concentration of hydrocarbon into the outer exhaust port 126.

Figure 16:
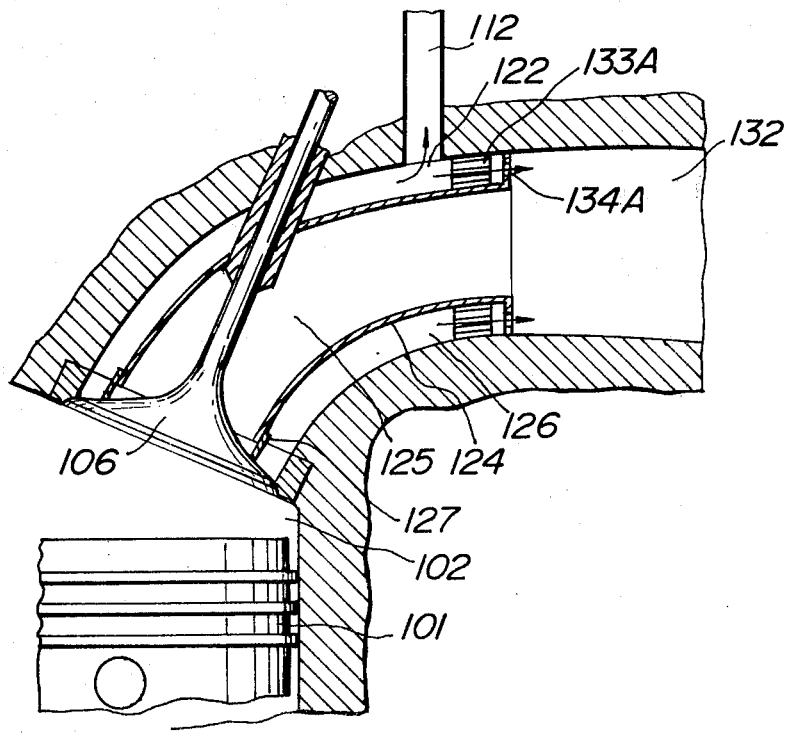
FIG. 16 is a sectional view of an exhaust port of another embodiment of the invention.
Figure 17:
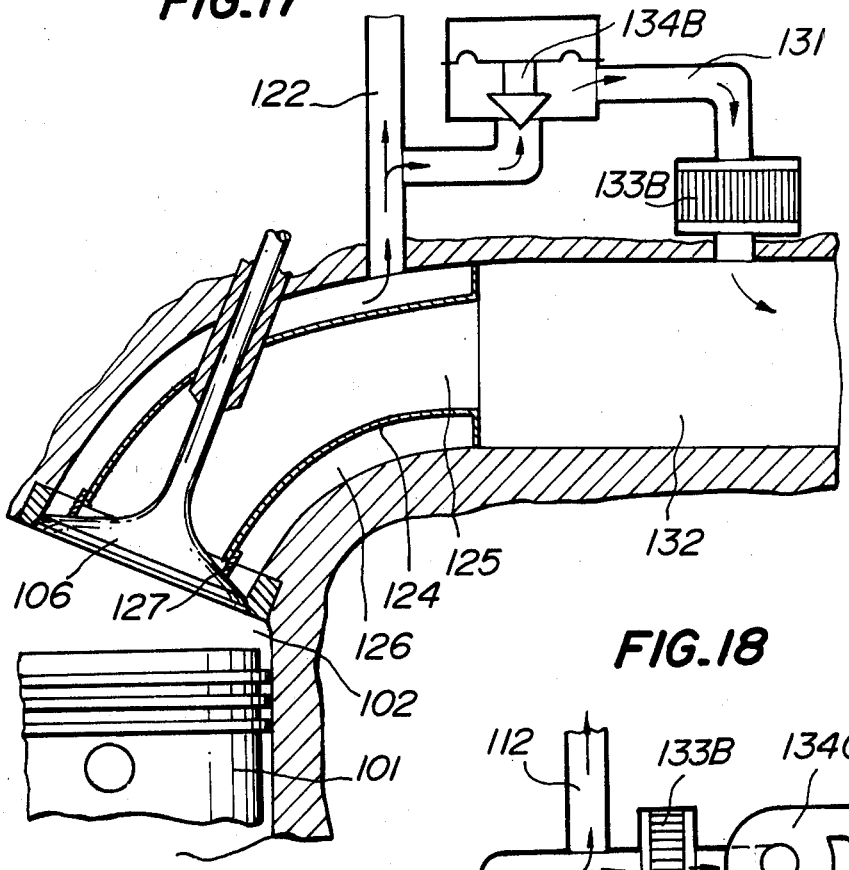
FIG. 17 is a sectional view of further embodiment of the present invention.
Figure 18:
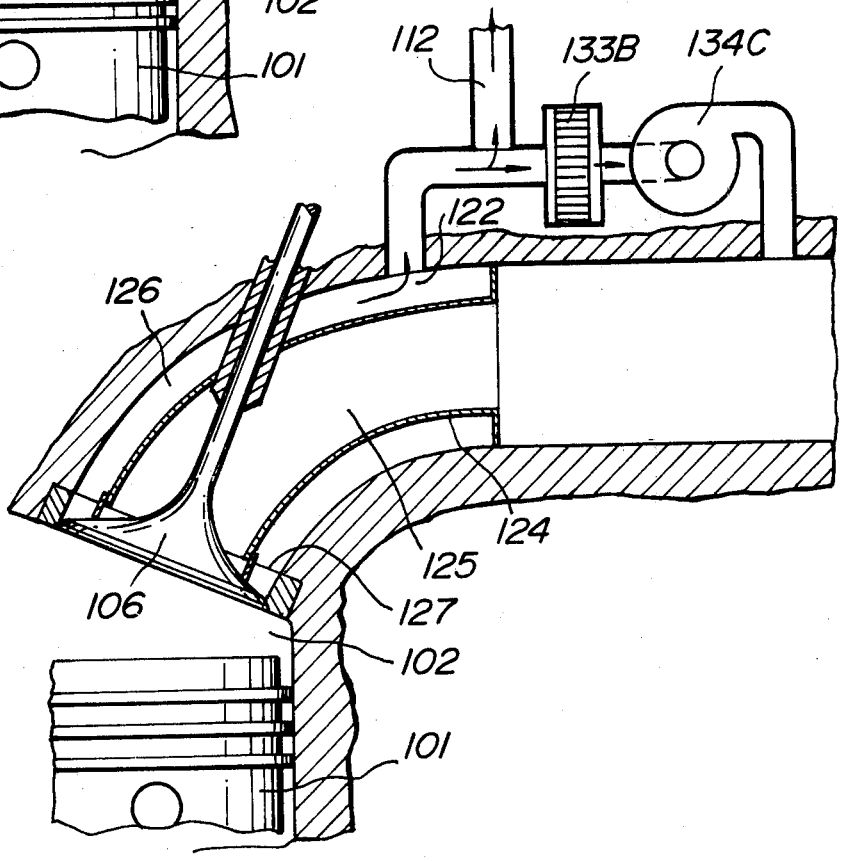
FIG. 18 is a sectional view of other embodiment of the invention.

Further concrete embodiments of the invention are shown in FIGS. 16–18.

In the embodiment shown in FIG. 16, a downstream end wall of the outer exhaust port 126 is formed with a plurality of small communicating apertures 134A to communicate the outer exhaust port 126 with the downstream passage of the inner exhaust port 125 and an oxidation catalyst 133A is interposed between the communicating apertures 134A and an exhaust extraction port 122.

With this arrangement, the extra exhaust gas having a high concentration of hydrocarbon corresponding to the pressure in the outer exhaust port 126 is exhausted through the communicating apertures 134A into the exhaust gas having the low concentration of hydrocarbon after being subjected to an oxidation treatment in the oxidation catalyst 133A as after-treatment means, so that the exhaust gas containing the highly concentrated hydrocarbon can be effectively extracted as the recirculation exhaust gas without extraordinarily raising or lowering the pressure in the outer exhaust port 126 and the extra exhaust gas can be exhausted in a low concentration of hydrocarbon to reduce the amount of the exhausted hydrocarbon. The system of this embodiment is very simple in construction and economical of manufacture.

FIG. 17 shows further embodiment, wherein instead of the pressure control means 134 shown in FIG. 15, a one way or check valve 134B opening at a pressure higher than a determined value is provided to maintain constant the pressure upstream of this valve. The extra exhaust gases having the high concentration of hydrocarbon passed through the check valves 134B of respective cylinders of the engine are gathered together and purified through an oxidation catalyst 133B and exhausted out of the engine.

In this embodiment, if the recirculation exhaust gas flow is much than the exhaust gas flow having the high concentration of hydrocarbon in the outer exhaust port 126, the recirculation gas would flow backward to cause the exhaust gas in the exhaust passage 132 to pass through the oxidation catalyst 133B. Such a reverse flow of the exhaust gas is of course unfavorable for the engine.

In order to avoid this reverse flow of the exhaust gas, a fluid diode 134C which causes a fluid to flow therethrough in one direction is arranged as a pressure regulating valve downstream of the oxidation catalyst 133B to raise the pressure between the exhaust extraction port 122 and the fluid diode 134C, thereby preventing the above reverse flow of the exhaust gas as shown in FIG. 18. An amount of exhaust gas required for the increased recirculation gas may be replenished only through the exhaust extraction ports 22.

As above described, according to the invention parts of exhaust gas having a high concentration of hydrocarbon are extracted from the flowing exhaust gas having alternately high and low concentrations of hydrocarbon to be recirculated into the intake duct, so that the decrease of NOx products resulting from the exhaust gas recirculation and the decrease of amount of hydrocarbon in exhaust gas owing to the recombustion of the exhaust gas having high concentration of hydrocarbon are simultaneously accomplished only by the exhaust gas recirculation. The decrease of the hydrocarbon in the exhaust gases means an effective utilization of fuel which lowers the fuel consumption and makes small the capacity of the after-treatment device for oxidation treatment of the hydrocarbon in the exhaust gas or makes it possible to dispense with such an after-treatment device.

According to the invention, moreover, the exhaust gas containing highly concentrated hydrocarbon is recirculated into an intake system of an engine while controlling the pressure in an exhaust port including the exhaust gas containing highly concentrated hydrocarbon and the extra recirculation gas is purified to be exhausted, thereby preventing the scavenging efficiency from being lowered due to the too high pressure in the highly concentrated hydrocarbon in the exhaust port, and further preventing the highly concentrated hydrocarbon from being mixed with the lower concentrated hydrocarbon due to the too low pressure in the highly concentrated hydrocarbon in the exhaust port, which would otherwise adversely affects the effects of the present invention. In exhausting the extra recirculation gas, the exhaust gas containing highly concentrated hydrocarbon is purified and thereafter exhausted to reduce the hydrocarbon components in the exhaust gases.

While the invention has been particularly shown and described with reference to preferred embodiments thereof, it will be understood by those skilled in the art that foregoing and other changes in form and details can be made therein without departing from the spirit and scope of the invention.

What is claimed is:

1. In an exhaust gas recirculation system for an internal combustion engine including an exhaust gas recirculation passage for communicating an exhaust port with an intake passage through a recirculation flow control valve, a normally closed timing valve provided in said exhaust gas recirculation passage and opening at specified moments for extracting exhaust gases having a high concentration of hydrocarbon flowing in said exhaust port into which an exhaust extraction port of said exhaust gas recirculation passage opens, said system comprising an inner exhaust port cylinder arranged in said exhaust port near the exhaust valve to divide said exhaust port into inner and outer double exhaust ports, said exhaust extraction port of said exhaust gas recirculation passage opening into the outer exhaust port, and a cylindrical shroud fixed to said exhaust valve so as to overlap an inner end of said inner exhaust port cylinder while the exhaust valve is slightly lifted.

2. A system as set forth in claim 1, wherein said exhaust extraction port of said exhaust gas recirculation passage opens at a plurality of openings in said exhaust port.

* * * * *